US007234886B2

(12) United States Patent
Tuozzo

(10) Patent No.: US 7,234,886 B2
(45) Date of Patent: Jun. 26, 2007

(54) FASTENING ARRANGEMENT FOR DETACHABLY INTERCONNECTING PUNCHED DOCUMENTS

(76) Inventor: James N. Tuozzo, 25 Avenue at Port Imperial, Apt 313, West New York, NJ (US) 07093

( * ) Notice: Subject to any disclaimer, the term of this patent is extended or adjusted under 35 U.S.C. 154(b) by 464 days.

(21) Appl. No.: 10/747,793

(22) Filed: Dec. 29, 2003

(65) Prior Publication Data

US 2005/0147462 A1 Jul. 7, 2005

(51) Int. Cl.
*B42F 3/02* (2006.01)
*B42F 13/02* (2006.01)

(52) U.S. Cl. ..... 402/19; 402/8; 402/13; 402/14; 402/15; 402/17; 281/21.1; 281/28; 19/32; 19/33; 19/65; 8/382; 294/6; 24/67 R; 24/67.5; 24/67.9; 24/67.11; 24/901

(58) Field of Classification Search ..... 402/8, 402/13, 14, 15, 17, 19; 281/21.1, 28; 24/901, 24/67 R, 67.3, 67.5, 67.9, 67.11, 902; D19/65, D19/32, 33, 6; D8/382; 294/6
See application file for complete search history.

(56) References Cited

U.S. PATENT DOCUMENTS 470,050 A * 3/1892 Jewell ..... 402/20
1,021,620 A * 3/1912 Miller ..... 24/67.1
1,936,144 A * 11/1933 Wagner ..... 402/17
2,468,072 A * 4/1949 Innacelli ..... 402/17
2,571,044 A * 10/1951 Lynch ..... 402/17
2,749,589 A * 6/1956 Carman, Jr. ..... 402/17
3,307,234 A * 3/1967 Murphy ..... 402/14
3,647,306 A * 3/1972 Chamberlin ..... 402/48
4,093,387 A 6/1978 Jonsson
4,300,848 A * 11/1981 Waegemann ..... 402/13
4,427,315 A * 1/1984 Raisch ..... 402/80 R
D295,422 S * 4/1988 Erickson ..... D19/32
4,887,925 A 12/1989 Groswith, III et al.
5,007,758 A 4/1991 Blumberg
5,028,160 A * 7/1991 Callander ..... 402/7
5,257,870 A 11/1993 Bennett et al.
5,364,199 A * 11/1994 Hillmer-Mann ..... 402/68
5,417,506 A 5/1995 Eenigenburg et al.

(Continued)

FOREIGN PATENT DOCUMENTS

DE 000541392 * 1/1932

(Continued)

*Primary Examiner*—Monica Carter
*Assistant Examiner*—Mark Henderson
(74) *Attorney, Agent, or Firm*—James N. Tuozzo, Esq.

(57) ABSTRACT

The present invention provides improvements in paper fastening to enable a user to remove a desired portion of papers from a fastened stack of papers without having to unnecessarily detach unwanted papers in the stack from the prongs of the fastener. The improved paper fastening arrangement is for use with a fastener having a base including two ends each having a leg extended therefrom, the leg foldable relative to the base. The arrangement comprises a sheath including an extension shaped to slideably engage one of the legs, the extension including an opening that defines a cavity to receive the leg, wherein the extension at least partially covers the leg and is operative to engage through sheet materials. At least one guide tab depends from the extension downward from the opening, the guide tab being foldable.

18 Claims, 9 Drawing Sheets

U.S. PATENT DOCUMENTS 5,593,242 A * 1/1997 Mathias ..... 402/7
5,667,322 A 9/1997 Mucznik
5,785,444 A 7/1998 Matsuura
5,862,579 A 1/1999 Blumberg
6,217,246 B1 4/2001 Yu
6,565,277 B1 5/2003 Huang
D522,581 S * 6/2006 Henry ..... D19/65
7,120,968 B2 * 10/2006 Huene et al. ..... 24/16 R

FOREIGN PATENT DOCUMENTS

GB 00210259 * 1/1924

* cited by examiner

FASTENING ARRANGEMENT FOR DETACHABLY INTERCONNECTING PUNCHED DOCUMENTS

FIELD OF THE INVENTION

The present invention generally relates to a fastener and fastening arrangement for detachably interconnecting punched documents. More particularly, the present invention relates to a system in which a prong-type binding system is made more efficient, providing a fastener which will hold a group of documents securely together while allowing easy removal of documents positioned within the group without disturbing, misaligning or disconnecting other documents within the group.

BACKGROUND OF THE INVENTION

Metal fasteners are commonly used in combination with file folders for securing papers within the folder. One of the more popular office-type prior-art sheet retainers used in binding a stack of hole-punched paper sheets together is the so-called ACCO™ prong binder shown in FIG. 1A hereof. In the ACCO™ binder a pair of prongs extending from a longitudinal base are inserted through spaced apertures from one side or top margin of a paper sheets stack, after which the prongs are bent 90° toward, or away from, each other against the top-most paper sheet in the stack. The paper stack is thus held temporarily at a margin by being pressed between the prong base and the pair of prongs extending therefrom. In some applications, prior to bending the prongs, a keeper, sometimes called a compressor bar, with rectangular or circular apertures is placed over the prongs from the opposite side of the stack so that the prongs pass through the apertures. The prongs are then bent 90° toward each other to rest in a longitudinal groove in the keeper and a pair of locking loops slidable along the groove are then positioned over the bent prongs to temporarily lock the prongs on the keeper. The paper stack is thus held temporarily at a margin by being pressed between the prong base and the keeper.

In either instance, the paper sheets in the stack are held securely together so that it is possible to leaf through the documents without them falling apart. But this type of fastener is subject to the criticism that when a paper, or a number of papers, resting within the stack has to be removed for any number of reasons, i.e., entering data, photocopying, presenting to a colleague, etc., all papers resting above any desired papers must also be removed from the stack. The need to remove papers from within a paper stack will happen quite frequently, e.g., with respect to medical records for hospital patients or legal documents for attorneys.

The problem associated with sequentially interconnected paper sheets on the prongs of the above mentioned prior-art fasteners is that, when there is a need to disconnect a paper, or a set of papers, from within the stack, it is necessary to individually disconnect (remove from the prong fastener) each paper in the stack resting above any desired papers. Disconnecting papers from the prong fastener results in an insecure stack of papers. Additionally, once the overlaying papers have been removed from the prongs, providing the user access to any desired papers lying beneath them, the user is left with the added task of realigning the hole-punched paper sheets of the now insecure (loose) group of overlaying papers that originally lay securely within the prongs of the fastener. This can be a tedious and time consuming task requiring the user to line up the punched holes of each individual paper with the prongs, sheet by sheet. Often, leading to much frustration, papers can become torn, misaligned on the prongs or not aligned at all, left laying freely within a folder or on a desk where they can easily be misplaced and/or lost.

The objective of this invention is to provide a fastening arrangement for detachably interconnecting hole-punched documents which has improvements and avoids the difficulties experienced by the prior-art fasteners described above.

SUMMARY OF THE INVENTION

The present invention provides improvements in paper fastening to enable a user to remove a desired portion of papers from a fastened stack of papers without having to unnecessarily detach unwanted papers in the stack from the prongs of the fastener. The improved paper fastening arrangement is for use with a fastener having a base including two ends each having a leg extended therefrom, the leg foldable relative to the base. The arrangement comprises a sheath including an extension shaped to slideably engage one of the legs, the extension including an opening that defines a cavity to receive the leg, wherein the extension at least partially covers the leg and is operative to engage through sheet materials. At least one foldable guide tab depends from the extension.

These and further objectives, features and advantages of the present invention will become more apparent from the following description when taken in connection with the accompanying drawings which show, for purposes of illustration only, several embodiments in accordance with the present invention.

DETAILED DESCRIPTION OF THE PREFERRED EMBODIMENTS

Figure 1A:
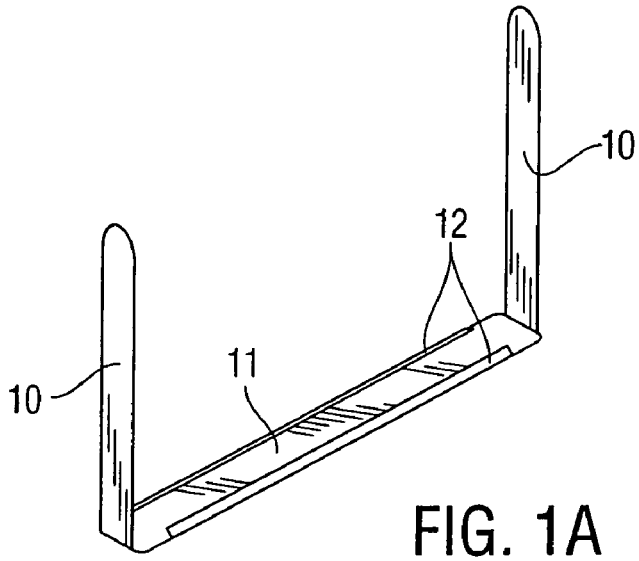
FIG. 1A PRIOR ART
FIG. 1A is a perspective view of a prior-art paper fastener (less paper stack)
Figure 1B:
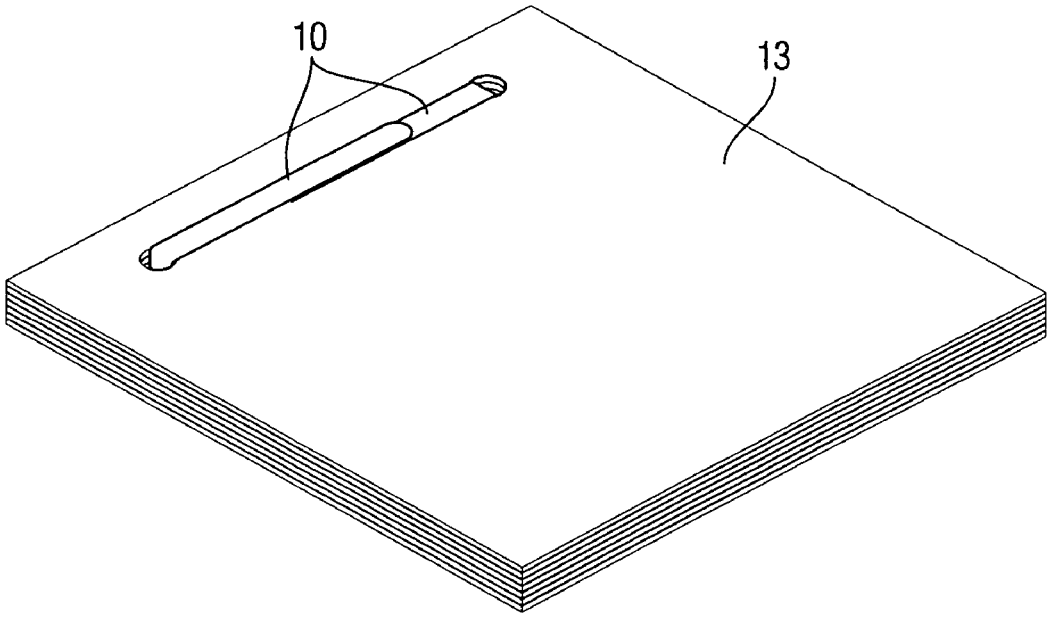
FIG. 1B PRIOR ART
FIG. 1B is a perspective view of a stack of papers collected by the prior-art paper fastener of FIG. 1A.

The prior-art prong fasteners have been described generally above, and the present invention has utility when used in connection with either of these fastener designs, and others. For purposes of describing a presently preferred embodiment, reference is made herein to the prior-art fasteners of FIGS. 1 and 2. Referring to FIG. 1A, a prior-art prong fastener includes an elongated thin metal base 11 and two thin metal prongs 10 extending from two ends of base 11. Metal prongs 10 are bendable to extend generally perpendicular from base 11 and are operable to pass through hole-punched paper (not shown). Referring to FIG. 1B, prongs 10 pass through a stack of hole-punched paper 13 and are bent 90° toward each other to rest against stack 13, thereby securing the sheets therein with base 11.

Figure 2A:
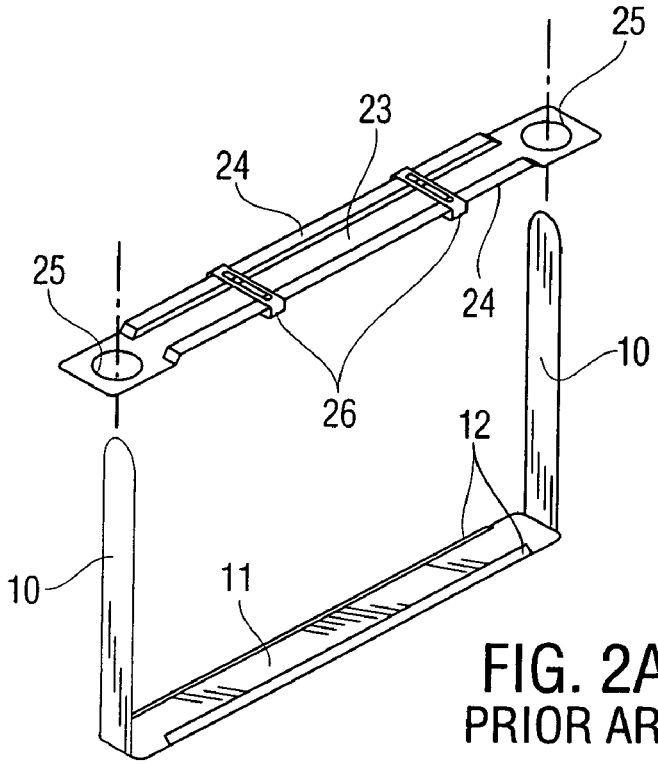
FIG. 2A PRIOR ART
FIG. 2A is a perspective view of a two-piece prior-art paper fastener.
Figure 2B:
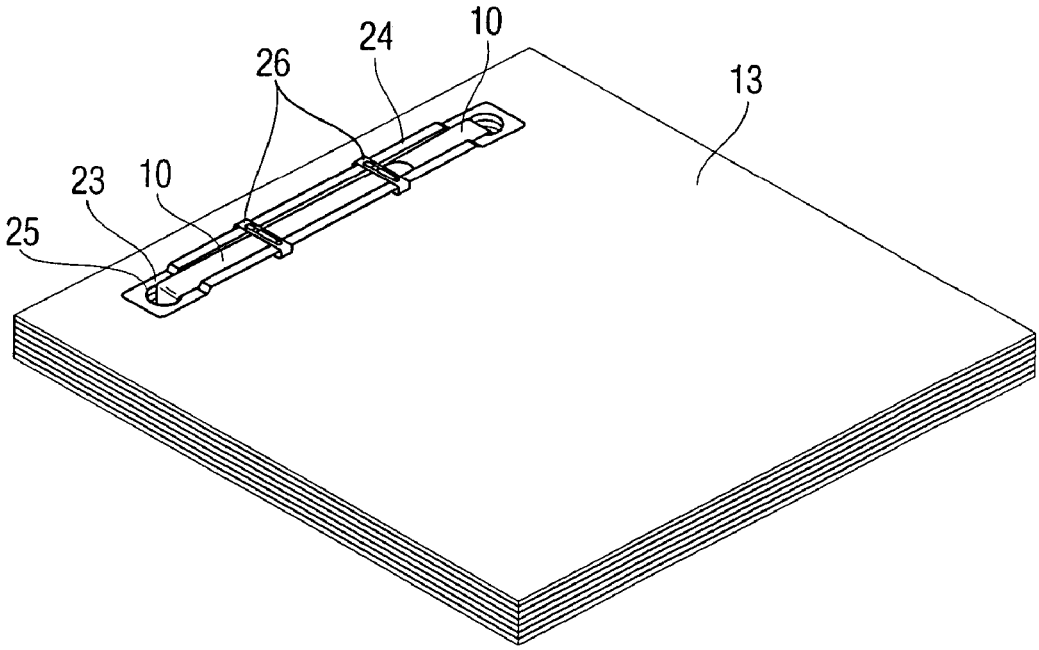
FIG. 2B PRIOR ART
FIG. 2B is a perspective view of a stack of papers collected by the two-piece prior-art paper fastener of FIG. 2A.

Referring to FIG. 2A, a two-piece prior-art prong fastener is shown and generally includes a prong base 11, bendable prongs 10 and a compressor 23 having end orifices 25 for receiving prongs 10. Prongs 10 pass through hole punched paper (not shown) and compressor 23. Compressor 23 includes two folded side flanges 24 and two slidably engaged retainers 26. Retainers 26 are operable for engaging with folded prongs 10 and for securing the paper sheets between base 11 and compressor 23. Side flanges 24 are substantially parallel to compressor 23 and are located slightly higher than compressor 23 for forming a recess or groove between compressor 23 and side flanges 24, respectively. Referring to FIG. 2B, after compressor 23 is cinched to prong base 11 with paper stack 13 therebetween, prongs 10 are bent 90° toward each other into the groove of compressor 23 and are locked in place by positioning retainers 26 over bent prongs 10. The completed binding will leave compressor 23, retainers 26 and bent prongs 10 exposed and raised on a marginal edge of paper stack 13 and the prong base 11 (not shown) exposed and raised on an underside marginal edge of paper stack 13.

Figure 3A:
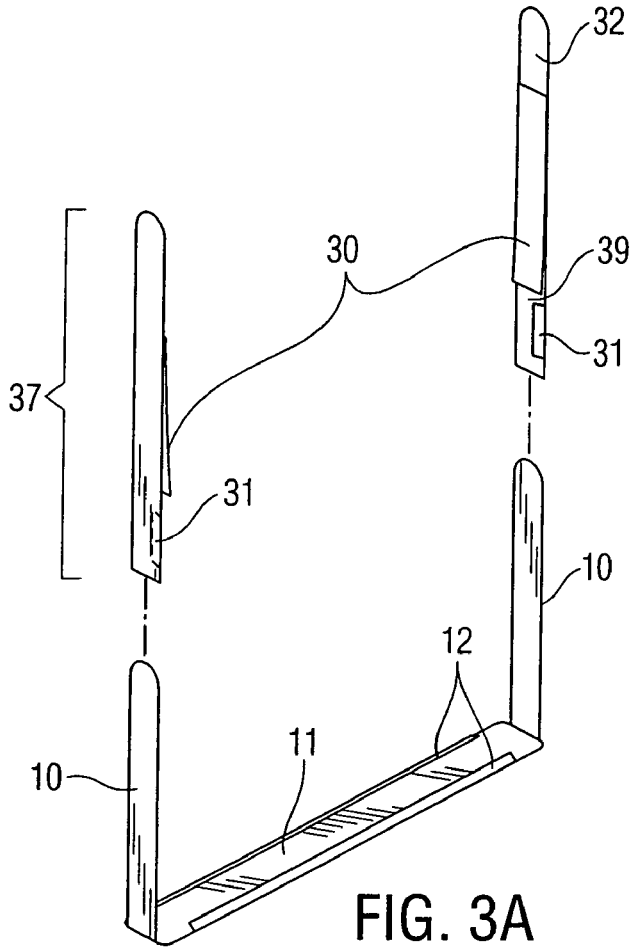
FIG. 3A is a perspective view of an improved fastening arrangement in accordance with the present invention showing the outer prongs detached from the inner prongs.
Figure 3B:
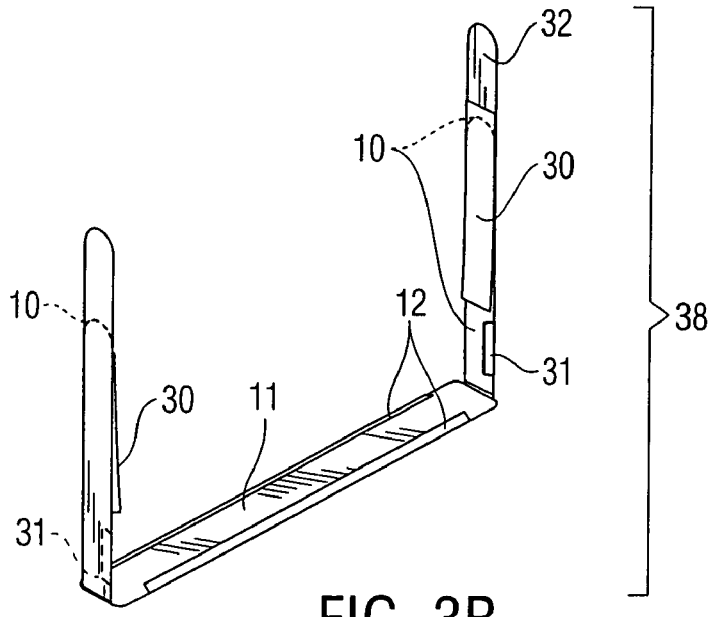
FIG. 3B is a perspective view of an improved fastening arrangement in accordance with the present invention showing the outer prongs and the inner prongs engaged.

Referring to FIGS. 3A and 3B, an improved fastening arrangement in accordance with the present invention is shown in conjunction with the fastener of FIG. 1. The fastener has an elongated base 11 including two ends each having a bendable leg (inner prong 10) extending therefrom. For a more complete description of such a fastener, see U.S. Pat. No. 6,565,277. As a departure from the prior art, a sheath (outer prong 37) comprising an extension (prong cover 30) with at least one bendable tab 39 attached thereto is provided few each inner prong 10. Tab 39 includes a side flange 31 extending longitudinally along a portion of its inner face. Side flange 31 is configured for slideably engaging inner prong 10, thereby guiding and securing outer prong 37 and tab 39 with inner prong 10. As illustrated in FIG. 3A tab 39 of outer prong 37 is aligned with an outside face of inner prong 10 in such a way for side flange 31 to receive a marginal edge of inner prong 10. When side flange 31 receives inner prong 10, prong cover 30 is aligned with inner prong 10. Once aligned, outer prong 37 can be slideably guided downward along inner prong 10 with a marginal edge of inner prong 10 partially encased by flange 31. Flange 31 assists in guiding inner prong 10 into prong cover 30. One of ordinary skill in the art will appreciate that prong cover 30, tab 39 and side flange 31 may, although not necessary to the spirit of the invention, abut a surface of and/or at least partially cover inner prong 10. Additionally, prong cover 30, tab 39 and side flange 31 may be integrally formed with outer prong 37 or alternatively composed of any number of suitable materials and bonded or affixed to a portion of outer prong 37.

Prong cover 30 and side flange 31 can be of varying longitudinal lengths and can be located in various locations along outer prong 37 without departing from the spirit or scope of the present invention. Additionally side flange 31 can extend horizontally along the entire width of outer prong 37. In accordance with a preferred embodiment of the present the invention, the length of prong cover 30 is approximately between ⅓ and 1/16 the length of inner prong 10. Also, side flange 31 preferably extends horizontally from opposite ends of tab 39 and spans the full width of outer prong 37.

According to a preferred embodiment, outer prong 37 is slightly longer in length than inner prong 10. Accordingly, topmost extension portion 32 extends above prong cover 30 and when outer prong 37 is completely engaged with inner prong 10, the top-most edge of inner prong 10 abuts an inner top-most surface of prong cover 30. Extension portion 32 of outer prong 37 does not contain inner prong 10 within, so as to enable selective detachment of a stack of interconnected hole-punched documents from a paper fastener as discussed below with reference to FIG. 4. As with the other components of outer prong 37, topmost extension portion 32 of outer prong 37 may be integrally formed with prong cover 30, or attached thereto, and is bendably operable (as are the entire inner and outer prongs).

Figure 4A:
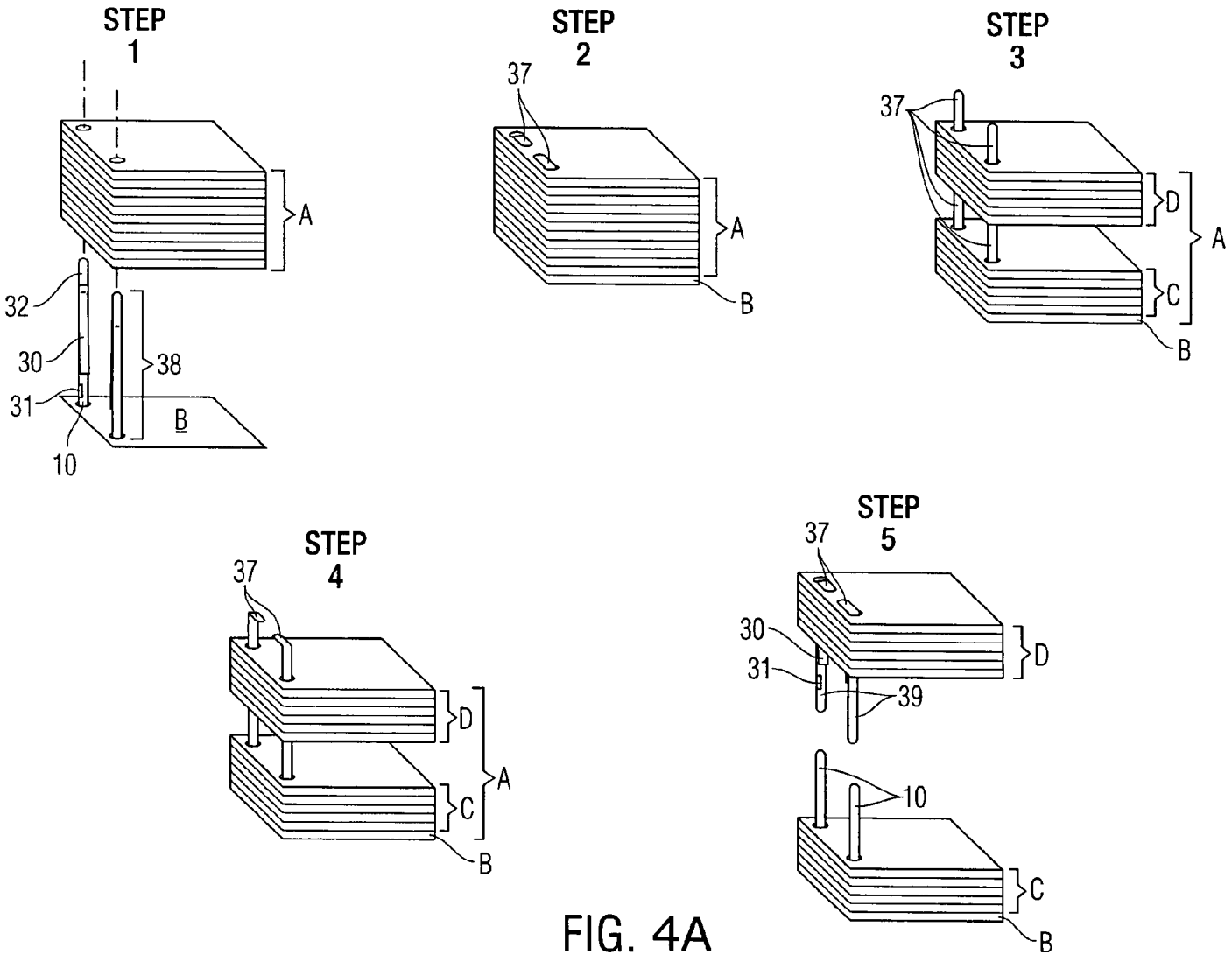
FIGS. 4A–4B show the steps for binding and unbinding documents utilizing the paper fastener of FIGS. 3A and 3B.
Figure 4B:
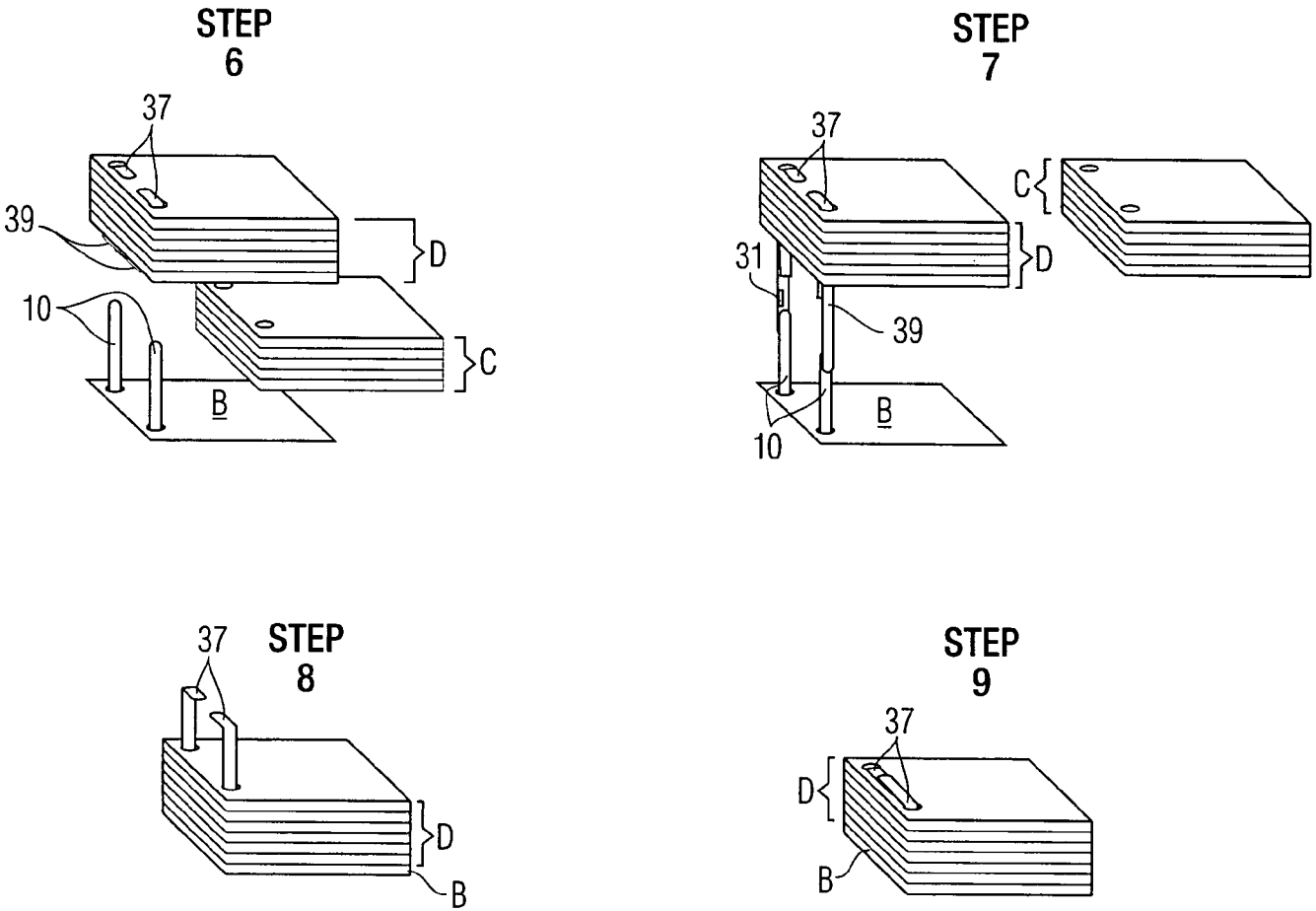

Referring to FIGS. 4A–4B, the steps for binding and unbinding documents utilizing the fastening arrangement of FIGS. 3A and 3B is described. The process begins at step 1 with stacking documents with binding holes aligned to form a stack A. Fastener 38 including outer prongs 37 can be inserted through a hole-punched folder, clip-board, paper, or the like, to form a platform on which stack A can be securely attached. However, one of ordinary skill in the art will appreciate that a platform is not essential and stack A may be connected directly to base 11 of fastener 38. Once aligned, the holes passing through stack A form a passageway for receiving outer prongs 37. Next, in step 2, stack A is guided over fastener 38 by fitting the holes around outer prongs 37. Depending on the size of stack A and/or fluctuations in the alignment of the holes punched into the documents contained in the stack, this task may require splitting stack A into several smaller stacks and individually guiding each smaller stack over fastener 38. Once prongs 37 have completely engaged each document of stack A, extending therethrough, outer prongs 37 are bent 90° toward each other and brought to rest against stack A, thereby securing the sheets of the stack with prong base 11. Bending outer prongs 37 in any location other than the topmost extension portion 32 will result in the concurrent bending of inner prongs 10 and have the additional effect of not only securing stack A, but also securing inner and outer prongs 10 and 37 together.

Upon completion of the binding operation in step 2 or sometime thereafter, there can be a need to disconnect (remove) a document or stack of documents C lying within the securely bound stack A from fastener 38. Normally, using a prior-art prong-type fastener, this task would require disconnecting all documents above the desired stack C from the fastener (resulting in numerous loose documents), removing stack C and reconnecting all the loose-lying documents that originally lay above it back onto the fastener.

This is a typical problem for all prior-art prong-type fasteners, as documents sequentially inserted atop prongs through an orifice in each document requires that these documents either be sequentially removed in the exact opposite order in which they were initially inserted (e.g., the first document in is the last document out), or that the orifices in the documents be destroyed by ripping documents free from the fastener thereby allowing their unsequential removal from the stack. Ripping documents from prong-type fasteners is undesirable and as mentioned above results in additional problems. One problem in particular is being unable to securely reinsert the torn document around the prongs of the fastener.

Therefore in accordance with a salient aspect of the present invention, step 3 has stack A divided into two stacks, stack D and stack C. For clarity in explanation, we will assume that all of the documents in stack C are desired to be disconnected (removed) from fastener 38 and that all documents in stack D are desired to remain aligned and securely bound in fastener 38 after the removal of the stack C. Outer prongs 37 with contained inner prongs 10 are bent 90° away from stack A (i.e., to a generally upright condition). With outer prongs 37 now pointing upward and the topmost extension portion 32 of each outer prong 37 extending through stack A, the outer prongs 37 are bent 90° inward, toward stack A, at or above prong cover 30 (at a location of extension portion 32) as shown in step 4. The significance of bending the outer prongs at a point above prong cover 30 is that, in this area, where outer prong 37 does not contain inner prong 10, only the outer prong is being bent, leaving inner prong 10 unaffected, unbent and generally upright.

Next, in step 5, stack D is moved upward along outer prongs 37 to a point where the stack contacts the bent portion of outer prongs 37. In this position the documents in stack D maintain alignment by outer prongs 37 passing therethrough while being unable to slide off over the top of outer prongs 37. Now, with the top-most paper of stack D in contact with the bent portion of outer prongs 37, stack D can be moved upward forcibly moving outer prongs 37 upward with it while inner prongs 10 remain in place. The material of extension portion 32 is selected so as to maintain a kink at the bend despite the ordinary change of forces that apply at the location of the bend due to lifting stack D. Stack D will continue upward, carrying outer prongs 37 with it, until outer prongs 37 become slideably detached from inner prongs 10, exposing tabs 39 extending outward through the bottom of stack D. Referring to step 6, once detached from stack C and inner prongs 10, the user, with stack D (including attached outer prongs 37) in hand, can bend tabs 39 90° inward to secure stack D proximate its bottom surface (that is, from below). Stack D is now securely bound at its top, by topmost extension portions 32 and at its bottom, by tabs 39.

With outer prongs 37 detached from inner prongs 10 and stack D securely bound by both top and bottom, desired stack C is accessible and can be slideably removed from inner prongs 10. As mentioned above, once disconnected from fastener 38, stack C may be permanently or temporarily removed from stack A depending on the user's needs. For example, the documents in stack C can be run through a photocopy machine after which the user can reinsert stack C back onto inner prongs 10, maintaining its order within stack A. In any event, referring to step 7, the process of rejoining stack D with platform B begins with the user holding stack D and bending tabs 39 90° outward from their current position against stack D, resulting in tabs 39 being essentially parallel (unbent and generally pointing downward) to prong cover 30. Next, each tab 39 of outer prongs 37 is aligned with an outside face of inner prong 10 such that flange 31 can receive a marginal edge of inner prong 10. Once aligned, outer prongs 37 are slideably guided downward along inner prongs 10 with a marginal edge of each inner prong 10 partially incased by flange 31. As each outer prong 37 continues downward, flange 31 guides inner prong 10 into prong cover 30. Once outer prongs 37 have engaged the entire length of inner prongs 10, the user can slideably move stack D downward around outer prongs 37 until it is brought to rest against platform B. As shown in step 8, the topmost extension portion 32 of outer prongs 37, that previous rest against the top of stack D, are now raised and exposed to the user. The user can now bend extension portions 32 90° away from stack D, essentially parallel to prong cover 30. Referring to step 9, once straightened, outer prongs 37 can be re-bent 90° toward (or away from) each other at a location below topmost extension portion 32 and brought to rest against stack D thereby securing the sheets of the stack with prong base 11.

The above mentioned unbending and rebending operations of steps 8 and 9, respectively, serve two purposes. First, outer prongs 37 which were previous bent at the location of the extension portion 32, or above, were accordingly disconnect from inner prongs 10. Unbending (straightening) extension portions 32 allows a user to now rebend outer prongs 37 below extension portions 32 resulting in the concurrent bending of inner prongs 10. This rebending operation secures stack D by a marginal edge of its topmost sheet and secures inner and outer prongs 10 and 37 together.

According to an alternative arrangement, once outer prongs 37 have engaged inner prongs 10, and after stack D is moved downward and brought to rest against platform B (step 8), outer prongs 37 can be slideably moved upward and disconnected from inner prongs 10. In this manner, outer prongs 37 assist the user in detaching stack C and rejoining stack D, after which they can be completely withdrawn and stack D can be fastened in a conventional manner using inner prongs 10. Additionally, if desired, a conventional compressor 23 (FIG. 2*a*) can be applied prior to the rebending operation of step 9. In such a case, orifices 25 of compressor 23 can be guided around/over unbent outer prongs 37. Next, compressor 23 is cinched to prong base 11 with stack D therebetween and outer prongs 37 are bent 90° toward each other into the groove of compressor 23. Outer prongs 37 are locked in place by positioning retainers 26 over the prongs.

Figure 5A:
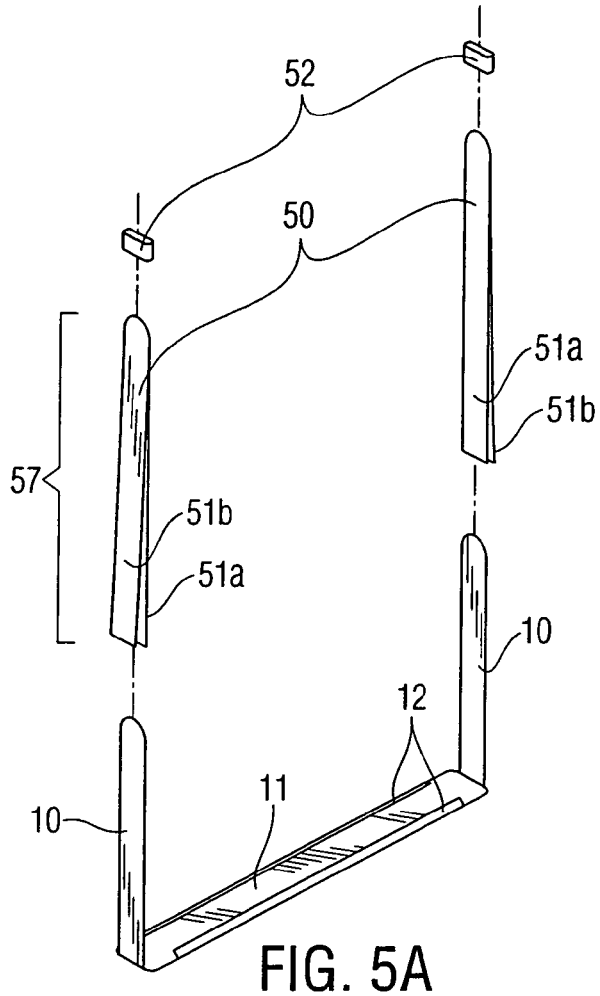
FIG. 5A is a perspective view of an improved fastening arrangement in accordance with a second embodiment of the present invention showing the outer prongs detached from the inner prongs.
Figure 5B:
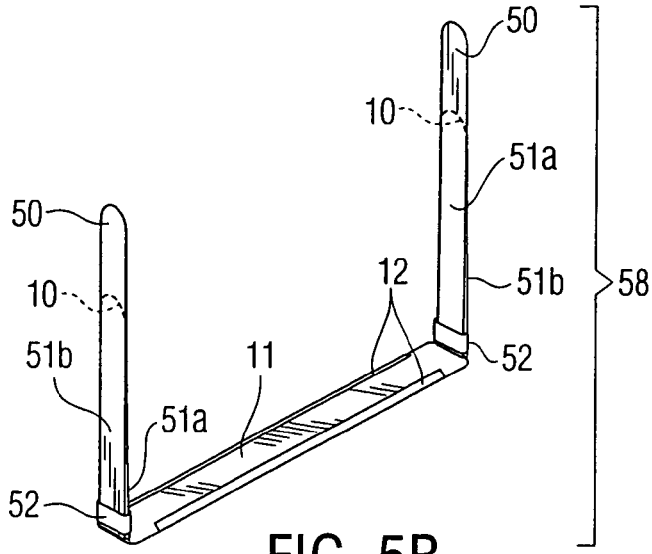
FIG. 5B is a perspective view of an improved fastening arrangement in accordance with a second embodiment of the present invention showing the outer prongs and the inner prongs engaged.

Referring to FIGS. 5A and 5B, an improved fastening arrangement in accordance with a second embodiment of the present invention is shown in conjunction with the fastener of FIG. 1. As a departure from the prior art, an outer prong 57 comprising a prong cover 50 with at least first and second bendable tabs 51*a*, 51*b* hingedly depending thereto and terminating in respective free ends is provided for each inner prong 10. As illustrated in FIG. 5A, tabs 51*a* and 51*b* of outer prong 57 are configured to align with respective outer and inner faces of inner prong 10 such that prong cover 50 can receive inner prong 10. Once aligned, outer prong 57 can be slideably guided downward over inner prong 10 with tabs 51*a* and 51*b* guiding inner prong 10 into prong cover 50. Prong cover 50 and tabs 51*a*, 51*b* may, although not necessary to the spirit of the invention, abut a surface of and at least partially cover inner prong 10. Additionally, prong cover 50 and tabs 51*a*, 51*b* may be integrally formed with outer prong 57 or alternatively composed of any number of suitable materials and bonded or affixed to a portion of outer prong 57.

Each outer prong 57 is provided with a locking loop 52 for slideably engaging outer prong 57 and securing tabs 51*a* and 51*b* to inner prong 10. Once outer prong 57 has fully engaged inner prong 10 locking loop 52 can be slideably moved downward around the outside surface of outer prong 57. As illustrated in FIG. 5B, in a secured position, locking loops 52 abut the exterior free ends of tabs 51*a* and 51*b* at or near base 11. With outer prongs 57 fully engaged with inner prongs 10 and locking loops 52 securing tabs 51*a*, 51*b* to inner prong 10 the fastening arrangement is in a position to receive a hole-punched paper stack.

Figure 6A:
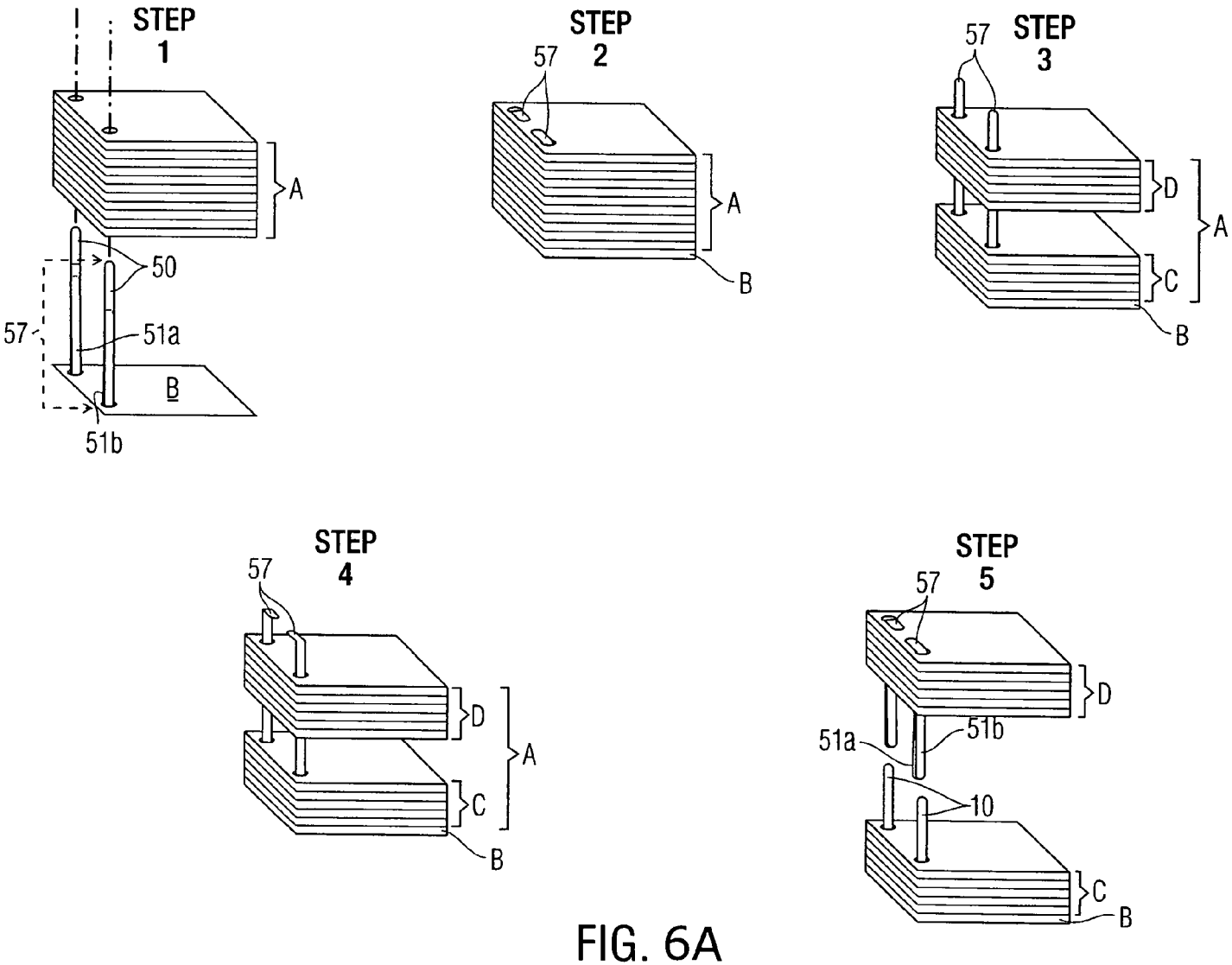
FIGS. 6A–6B show the steps for binding and unbinding documents utilizing the paper fastener of FIGS. 5A and 5B.
Figure 6B:
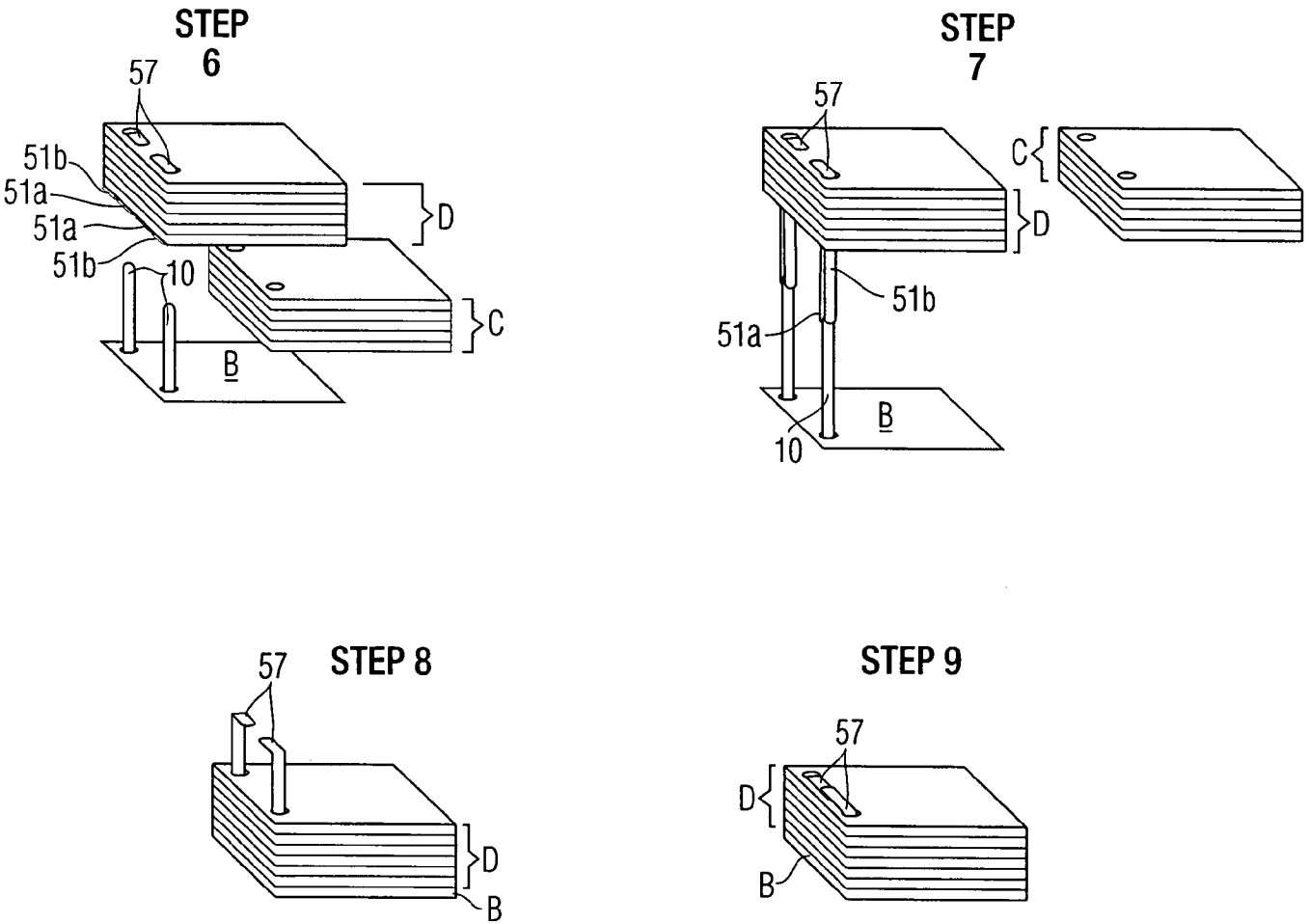

Referring to FIGS. 6A–6B, the steps for binding and unbinding documents utilizing the fastening arrangement of FIGS. 5A and 5B is described. The process begins at step 1 with stacking documents with binding holes aligned to form a stack A. Once aligned, the holes passing through stack A form a passageway for receiving outer prongs 57. Next, in step 2, stack A is guided over fastener 58 by fitting the holes around outer prongs 57. Once prongs 57 have completely engaged each document of stack A, extending therethrough, outer prongs 57 are bent 90° toward each other and brought to rest against stack A, thereby securing the sheets of the stack with prong base 11. Bending outer prongs 57 will result in the concurrent bending of inner prongs 10 and have the additional effect of not only securing stack A, but also securing inner and outer prongs 10 and 57, respectively, together.

Upon completion of the binding operation in step 2 or sometime thereafter, there can be a need to disconnect (remove) a document or stack of documents C lying within the securely bound stack A from fastener 58. Referring to step 3, stack A is divided into two stacks, stack D and stack C. For clarity in explanation, we will assume that all of the documents in stack C are desired to be disconnected (removed) from fastener 58 and that all documents in stack D are desired to remain aligned and securely bound in fastener 58 after the removal of the stack C. Outer prongs 57 with contained inner prongs 10 are bent 90° away from stack A (i.e., to a generally upright condition). Referring to step 4, with outer prongs 57 now pointing upward and extending through stack A, the outer prongs 57 are slideably moved upward creating a length of each outer prong 57 that does not contain inner prong 10 within. Next, outer prongs 57 can be bent 90° inward, toward stack A, in a position that does not contain inner prong 10. In this position, where outer prong 57 does not contain inner prong 10, only the outer prong is being bent, leaving each inner prong 10 unaffected, unbent and generally upright.

Next, in step 5, stack D is moved upward along outer prongs 57 to a point where the stack contacts the bent portion of outer prongs 57. In this position the documents in stack D maintain alignment by outer prongs 57 passing therethrough while being unable to slide off over the top of outer prongs 57. Now, with the top-most paper of stack D in contact with the bent portion of outer prongs 57, stack D can be moved upward forcibly moving outer prongs 57 upward with it while inner prongs 10 remain in place. The material of outer prong 57 is selected so as to maintain a kink at the bend despite the ordinary change of forces that are applied at the location of the bend due to lifting stack D. Stack D will continue upward, carrying outer prongs 57 with it, until outer prongs 57 become slideably detached from inner prongs 10, exposing bendable tabs 51*a* and 51*b* extending outward through the bottom of stack D. Referring to step 6, once detached from stack C and inner prongs 10, the user, with stack D (including attached outer prongs 57) in hand, can bend tabs 51*a* and 51*b* 90° away from each other to secure stack D proximate its bottom surface (that is, from below). Stack D is now securely bound at its top, by the bent portion of outer prongs 57 and at its bottom, by tabs 51*a* and 51*b*.

With outer prongs 57 detached from inner prongs 10 and stack D securely bound by both top and bottom, desired stack C is accessible and can be slideably removed from inner prongs 10. As mentioned above, once disconnected from fastener 58, stack C may be permanently or temporarily removed from stack A depending on the user's needs. For example, the documents in stack C can be run through a photocopy machine after which the user can reinsert the stack around inner prongs 10, maintaining its order within stack A. In any event, referring to step 7, the process of rejoining stack D with platform B begins with the user holding stack D and bending tabs 51*a* and 51*b* 90° inward from their current position against stack D, resulting in tabs 51*a* and 51*b* being essentially parallel (unbent and generally pointing downward) to prong cover 50. Next, each tab of outer prong 57 is aligned with an inner and outer face of inner prong 10 such that prong cover 50 can receive inner prong 10. Once aligned, the top bent portions of outer prongs 57 can be bent 90° away from stack D (unbent and generally pointing upward) so as to allow inner prongs 10 to engage the full length of outer prongs 57. Outer prongs 57 are slideably guided downward along inner prongs 10. As each outer prong 57 continues downward, tabs 51*a* and 51*b* guide inner prong 10 into prong cover 50. Once outer prongs 57 have engaged the entire length of inner prongs 10, the user can slideably move stack D downward around outer prongs 57 until it is brought to rest against platform B (step 8). Referring to step 9, the user can now bend outer prongs 57 90° toward (or away from) each other at a location near the top sheet of stack D. Outer prongs are bent to rest against stack D thereby securing the sheets of the stack by a marginal edge of its topmost sheet and securing inner and outer prongs 10 and 57, respectively, together.

According to an alternative arrangement, once outer prongs 57 have engaged inner prongs 10, and after stack D is moved downward and brought to rest against platform B (step 8), locking loops 52 can be engaged around each outer prong 57 and slideably moved downward around the outside surface of each outer prong 57. Locking loops 52 can be used to further secure tabs 51*a* and 51*b* to inner prong 10.

Figure 7A:
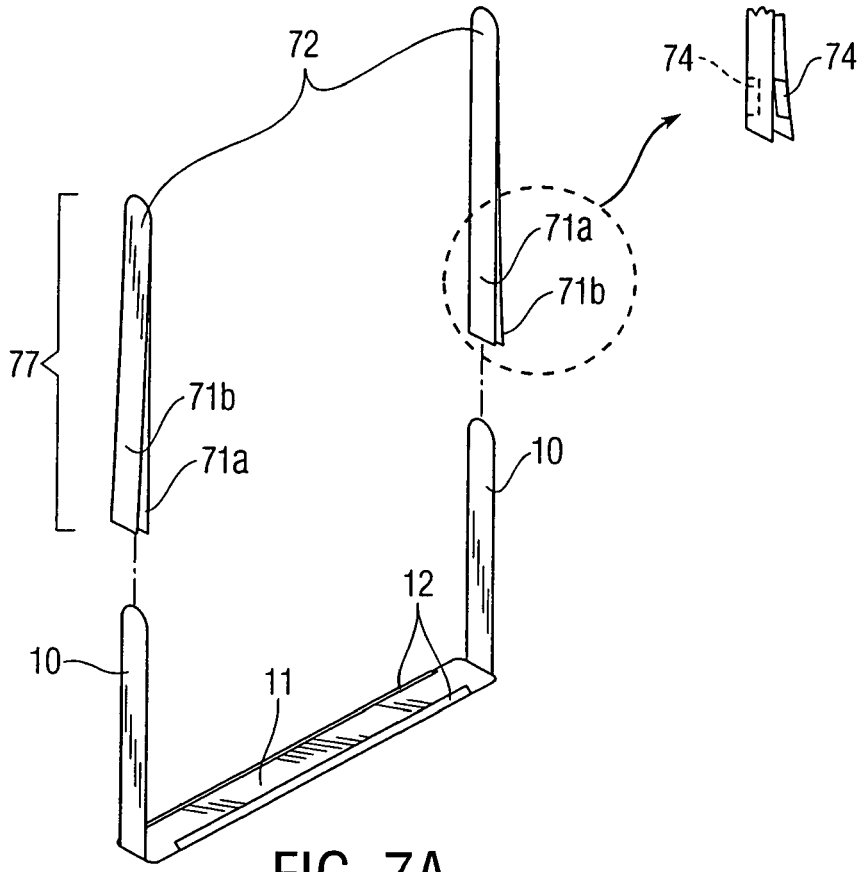
FIG. 7A is a perspective view of an improved fastening arrangement in accordance with a third embodiment of the present invention showing the outer prongs detached from the inner prongs.
Figure 7B:
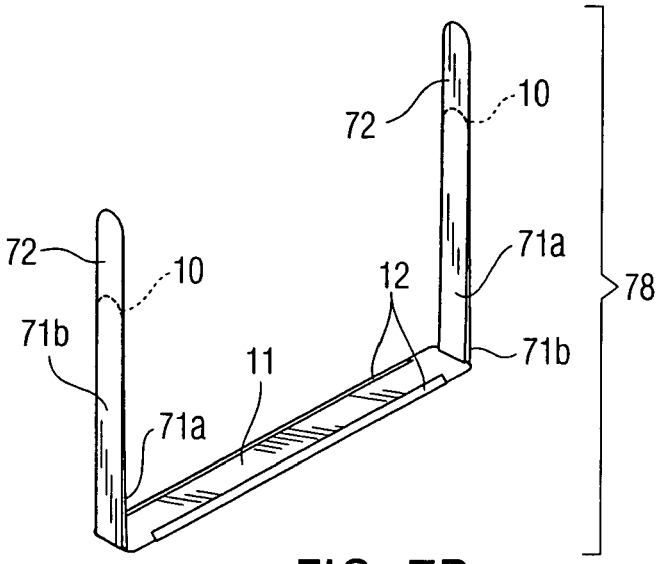
FIG. 7B is a perspective view of an improved fastening arrangement in accordance with a third embodiment of the present invention showing outer prongs and the inner prongs engaged.

Referring to FIGS. 7A and 7B, an improved fastening arrangement in accordance with a third embodiment of the present invention is shown in conjunction with the fastener of FIG. 1. As a departure from the prior art, an outer prong 77 comprising a prong cover 70 with at least first and second bendable tabs 71*a*, 71*b* hingedly depending thereto and terminating in respective free ends is provided for each inner prong 10. Tabs 71*a* and 71*b* include at least a first side flange 74 extending longitudinally along a portion of the inner face of each tab. Side flange 74 can be disposed on a tab's edge whereby an adjacent tab does not contain a side flange on the same edge. In this regard, tabs 71*a* and 71*b* do not contain side flanges directly facing each other.

As illustrated in FIG. 7A, tabs 71*a* and 71*b* of outer prong 77 are aligned with respective outer and inner faces of inner prong 10 in such a way for each side flange 74 to receive a marginal edge of inner prong 10, and for prong cover 70 to receive inner prong 10. When side flanges 74 receive inner prong 10, prong cover 70 is aligned with inner prong 10. Once aligned, outer prong 77 can be slideably guided downward over inner prong 10 with marginal edges of inner prong 10 partially encased by flanges 74. Flanges 74 assist in guiding inner prong 10 into prong cover 70. Prong cover 70, tabs 71*a*, 71*b*, and side flanges 74 may, although not necessary to the spirit of the invention, abut a surface of and at least partially cover inner prong 10. Additionally, prong cover 70, tabs 71*a*, 71*b*, and side flanges 74 may be integrally formed with outer prong 77 or alternatively composed of any number of suitable materials and bonded or affixed to a portion of outer prong 77.

Outer prong 77 is slightly longer in length than inner prong 10. Accordingly, topmost extension portion 72 extends above prong cover 70 and when outer prong 77 is completely engaged with inner prong 10, the top-most edge of inner prong 10 abuts an inner top-most surface of prong cover 70. Extension portion 72 of outer prong 77 does not contain inner prong 10 within, so as to enable selective detachment of a stack of interconnected hole-punched documents from a paper fastener. As with the other components of outer prong 77, topmost extension portion 72 of outer prong 77 may be integrally formed with prong cover 70, or attached thereto, and is bendably operable (as are the entire inner and outer prongs). Also, one of ordinary skill in the art will appreciate that the above discussed embodiment will function equally well with, or without, extension portion 72 (i.e., FIGS. 5 and 6).

According to an alternative arrangement and as discussed above, each outer prong 77 can be provided with a locking loop for slideably engaging outer prong 77 and further securing tabs 71*a* and 71*b* to inner prong 10. Once outer prong 77 has fully engaged inner prong 10, locking loops can be slideably moved downward around the outside surface of outer prong 77.

The steps for binding and unbinding documents utilizing the fastening arrangement of FIGS. 7A and 7B begins at step 1 with stacking documents with binding holes aligned to form a stack A. Once aligned, the holes passing through stack A form a passageway for receiving outer prongs 77. Next, in step 2, stack A is guided over fastener 78 by fitting the holes around outer prongs 77. Once prongs 77 have completely engaged each document of stack A, extending therethrough, outer prongs 77 are bent 90° toward each other and brought to rest against stack A, thereby securing the sheets of the stack with prong base 11. Bending outer prongs 77 in any location other than the topmost extension portion 72 will result in the concurrent bending of inner prongs 10 and have the additional effect of not only securing stack A, but also securing inner and outer prongs 10 and 77 together.

Upon completion of the binding operation in step 2 or sometime thereafter, there can be a need to disconnect (remove) a document or stack of documents C lying within the securely bound stack A from fastener 78. Referring to step 3, stack A is divided into two stacks, stack D and stack C. For clarity in explanation, we will assume that all of the documents in stack C are desired to be disconnected (removed) from fastener 78 and that all documents in stack D are desired to remain aligned and securely bound in fastener 78 after the removal of the stack C. Outer prongs 77 with contained inner prongs 10 are bent 90° away from stack A (i.e., to a generally upright condition). Referring to step 4, with outer prongs 77 now pointing upward and the topmost extension portion 72 of each outer prong 77 extending through stack A, the outer prongs 77 are bent 90° inward, toward stack A, at or above prong cover 70 (at a location of extension portion 32). The significance of bending the outer prongs at a point above prong cover 70 is that, in this area, where outer prong 77 does not contain inner prong 10, only the outer prong is being bent, leaving each inner prong 10 unaffected, unbent and generally upright.

Next, in step 5, stack D is moved upward along outer prongs 77 to a point where the stack contacts the bent portion of outer prongs 77. In this position the documents in stack D maintain alignment by outer prongs 77 passing therethrough while being unable to slide off over the top of outer prongs 77. Now, with the top-most paper of stack D in contact with the bent portion of outer prongs 77, stack D can be moved upward forcibly moving outer prongs 77 upward with it while inner prongs 10 remain in place. The material of extension portion 72 is selected so as to maintain a kink at the bend despite the ordinary change of forces that are applied at the location of the bend due to lifting stack D. Stack D will continue upward, carrying outer prongs 77 with it, until outer prongs 77 become slideably detached from inner prongs 10, exposing bendable tabs 71*a* and 71*b* extending outward through the bottom of stack D. Referring to step 6, once detached from stack C and inner prongs 10, the user, with stack D (including attached outer prongs 77) in hand, can bend tabs 71*a* and 71*b* 90° inward to secure stack D proximate its bottom surface (that is, from below). Stack D is now securely bound at its top, by topmost extension portions 72 and at its bottom, by tabs 71*a* and 71*b*.

With outer prongs 77 detached from inner prongs 10 and stack D securely bound by both top and bottom, desired stack C is accessible and can be slideably removed from inner prongs 10. As mentioned above, once disconnected from fastener 78, stack C may be permanently or temporarily removed from stack A depending on the user's needs. For example, the documents in stack C can be run through a photocopy machine after which the user can reinsert the stack around inner prongs 10, maintaining its order within stack A. In any event, referring to step 7, the process of rejoining stack D with platform B begins with the user holding stack D and bending tabs 71*a* and 71*b* 90° outward from their current position against stack D, resulting in tabs 71*a* and 71*b* being essentially parallel (unbent and generally pointing downward) to prong cover 70. Next, each tab of outer prong 77 is aligned with inner prong 10 such that each side flange 74 can receive a marginal edge of inner prong 10. Once aligned, outer prongs 77 are slideably guided downward along inner prongs 10 with a marginal edge of each inner prong 10 partially incased by flanges 74. As each outer prong 77 continues downward, flanges 74 guide inner prong 10 into prong cover 70. Once outer prongs 77 have engaged the entire length of inner prongs 10, the user can slideably move stack D downward around outer prongs 77 until it is brought to rest against platform B. As shown in step 8, the topmost extension portions 72 of outer prongs 77, that previous rest against the top of stack D, are now raised and exposed to the user. The user can now bend extension portions 72 90° away from stack D, essentially parallel to prong cover 70. Referring to step 9, once straightened, outer prongs 77 can be re-bent 90° toward (or away from) each other at a location below topmost extension portion 72 and brought to rest against stack D thereby securing the sheets of the stack with prong base 11.

The above mentioned unbending and re-bending operations of step 8 and 9 serve two purposes. First, outer prongs 77 which were previous bent at the location of the extension portion 72, or above, were accordingly disconnect from inner prongs 10. Unbending (straightening) extension portions 72 allows a user to now re-bend outer prongs 77 below extension portions 72 resulting in the concurrent bending of inner prongs 10. This re-bending operation secures stack D by a marginal edge of its topmost sheet and secures inner and outer prongs 10 and 77 together.

According to an alternative arrangement, once outer prongs 77 have engaged inner prongs 10, and after stack D is moved downward and brought to rest against platform B (step 8), outer prongs 77 can be slideably moved upward and disconnected from inner prongs 10. In this manner, outer prongs 77 assist the user in detaching stack C and rejoining stack D, after which they can be withdrawn and stack D can be fastened in a conventional manner using only inner prongs 10.

Although this invention has been described with a certain degree of particularity, it is to be understood that the present disclosure has been made by way of example only and that numerous changes in the detailed construction and the combination and arrangement of parts may be resorted to without departing form the spirit and scope of the invention as hereinafter claimed.

I claim:

1. An improved paper fastening arrangement for use with a fastener having a base including two ends each having a leg extended therefrom, the leg foldable relative to the base, a sheath comprising:

an extension shaped to slideably engage one of the legs, the extension including an opening that defines a cavity to receive the leg, wherein the extension at least partially covers the leg;

at least one foldable guide tab depending from the extension, the guide tab having a flange bent relative to the guide tab to form a recess between the flange and the guide tab, whereby the recess receives the leg; and wherein the extension and the guide tab are sized to fit through hole-punched sheet materials.

2. The paper fastening arrangement as in claim 1, wherein the flange secures the sheath and the leg.

3. The paper fastening arrangement as in claim 1 wherein the sheath includes a solid portion closing the opening either at a top of the sheath or at a distance below the top of the sheath.

4. The paper fastening arrangement as in claim 1 further comprising a retainer to slideably engage with the sheath, for securing the sheath and the leg.

5. The paper fastening arrangement as in claim 1 further comprising a retaining means for securing the sheath and the leg.

6. The paper fastening arrangement as in claim 1 wherein the flange is folded toward the guide tab to form a rounded side edge thereof.

7. The paper fastening arrangement as in claim 1 wherein the flange extends across the guide tab to an opposite edge of the guide tab from which it depends.

8. The paper fastening arrangement as in claim 1 further comprising a compressor having opposing top and bottom surfaces and two holes respectively formed through two end portions of the compressor, said compressor operable to engage the sheath by receiving at least a portion of the extension in one of the two holes.

9. The paper fastening arrangement as in claim 1 further comprising at least a second foldable guide tab depending from the opening of the extension.

10. The paper fastening arrangement as in claim 1 wherein the cavity is configured to receive the entire length of the leg.

11. The paper fastening arrangement as in claim 1 wherein the sheath, the extension and the guide tab are integrally formed.

12. A paper fastener comprising:

a base including two ends each having a leg extended therefrom, the leg foldable relative to the base;

a sheath for slidably engaging one of the legs, the sheath comprising an open bottom forming a cavity to receive the leg, wherein the sheath at least partially covers the leg and is operative to engage through sheet materials;

the sheath comprising at least one guide tab extending from the open bottom and foldable therefrom, wherein the guide tab comprises a flange bent relative to the guide tab to form a recess between the flange and the guide tab, whereby the recess is configured to receive the leg; and wherein the guide tab is sized to fit through hole-punched sheet materials.

13. The paper fastener as in claim 12 wherein the flange secures the sheath and the leg.

14. The paper fastener as in claim 12 wherein the sheath includes a solid portion closing the cavity, the solid portion located either at an end of the sheath or proximate the end of the sheath.

15. The paper fastener as in claim 12 further comprising a retainer to slidably engage with the sheath, for securing the sheath and the leg.

16. The paper fastener as in claim 15 wherein said retainer engages the guide tab when the guide tab is parallel with the leg, and the retainer secures the guide tab and the leg.

17. The paper fastener as in claim 12 wherein the sheath includes at least a second foldable guide tab extending from the open bottom.

18. A paper fastening attachment for use with a fastener having a base including two ends each having a prong extending therefrom, the prong bendable relative to the base, comprising:

a prong cover shaped to slideably engage and at least partially cover the prong, the prong cover comprising:

a top end and an open bottom proximate the top end, the open bottom to receive the prong; and at least one tab hingedly depending from the open bottom and terminating in a free end opposite the top end, wherein the prong cover and the tab are sized to fit through hole-punched sheet materials.

* * * * *